United States Patent [19]

Ingram

[11] 4,404,916

[45] Sep. 20, 1983

[54] MULTIPLE ENTRY CLOSURE FOR A SAFE OR VAULT

[75] Inventor: Bert M. Ingram, Santa Paula, Calif.

[73] Assignee: Ingram Security Inc., Santa Paula, Calif.

[21] Appl. No.: 218,538

[22] Filed: Dec. 22, 1980

[51] Int. Cl.[3] ..... E06B 7/00; E05B 13/00

[52] U.S. Cl. ..... 109/67; 109/64; 109/60; 70/DIG. 63

[58] Field of Search ..... 109/64, 67, 68, 78, 109/57, 76, 66, 60; 70/DIG. 63, 427, 119

[56] References Cited

U.S. PATENT DOCUMENTS

| | | | |
|---|---|---|---|
| 3,158,017 | 11/1964 | Guze | 70/119 |
| 3,747,541 | 7/1973 | Reese | 109/64 |
| 3,945,329 | 3/1976 | Bywater | 109/68 |
| 4,073,165 | 2/1978 | Grundstrom et al. | 70/427 |
| 4,107,967 | 8/1978 | Grabb | 70/427 |
| 4,123,978 | 11/1978 | Lentini | 109/68 |

FOREIGN PATENT DOCUMENTS

| | | | |
|---|---|---|---|
| 2107589 | 10/1971 | Fed. Rep. of Germany | 109/68 |
| 196815 | 5/1923 | India | 109/68 |

*Primary Examiner*—Gene Mancene
*Assistant Examiner*—John Weiss
*Attorney, Agent, or Firm*—Harlan P. Huebner

[57] ABSTRACT

A multiple entry closure for a safe or vault wherein said closure includes a hinged door mounted in the safe or vault and having a locking means to maintain the door in a closed position. The hinged door is positioned whereby it is co-planar with the surroundings when installed. The door is of a periphery less than the surface into which it is mounted. A lift-out door having a door locking means is mounted in said hinged door and is of a lesser peripheral area than said hinged door. Said lift-out door requiring removal to obtain access to said door locking means and limited access to the interior of said safe or vault. The said hinged door when closed limits full access to the interior of said safe or vault until unlocked and hinged outwardly of said safe or vault.

13 Claims, 8 Drawing Figures

FIG. 1.
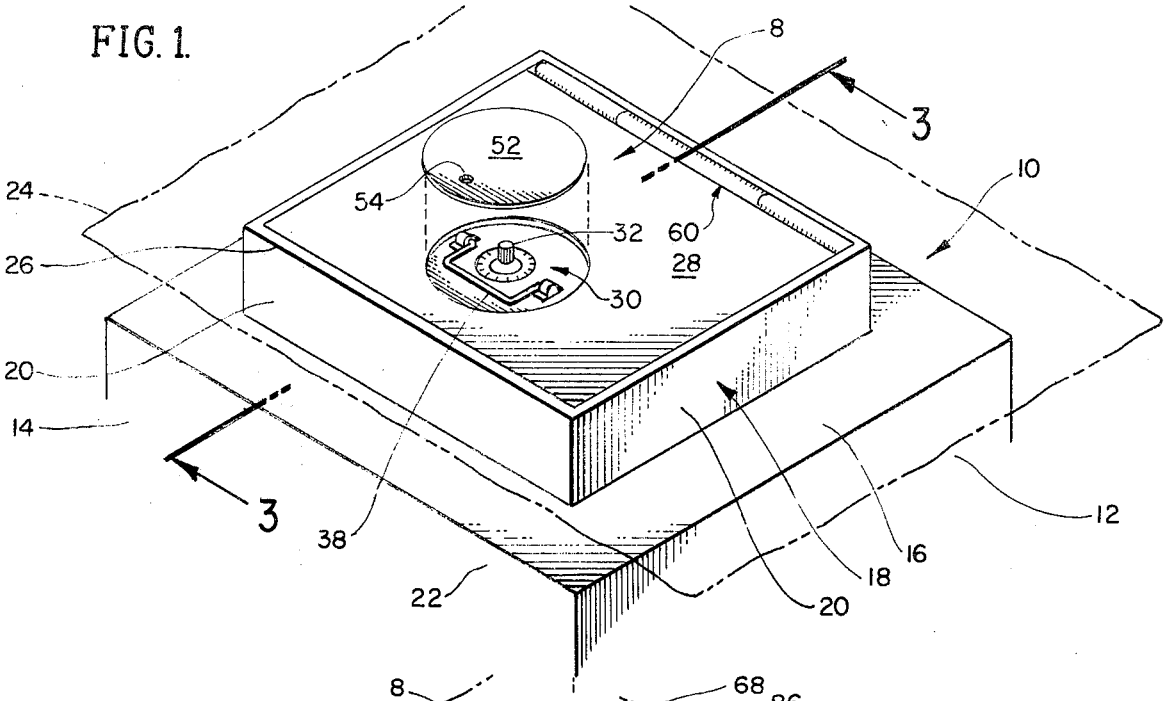
FIG. 2.
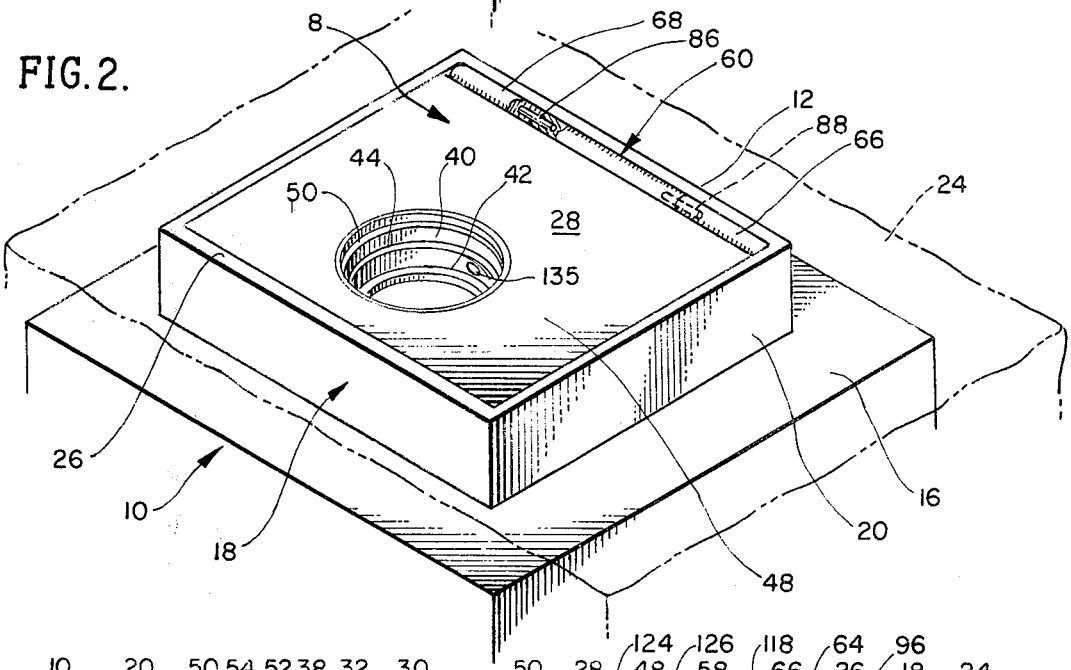
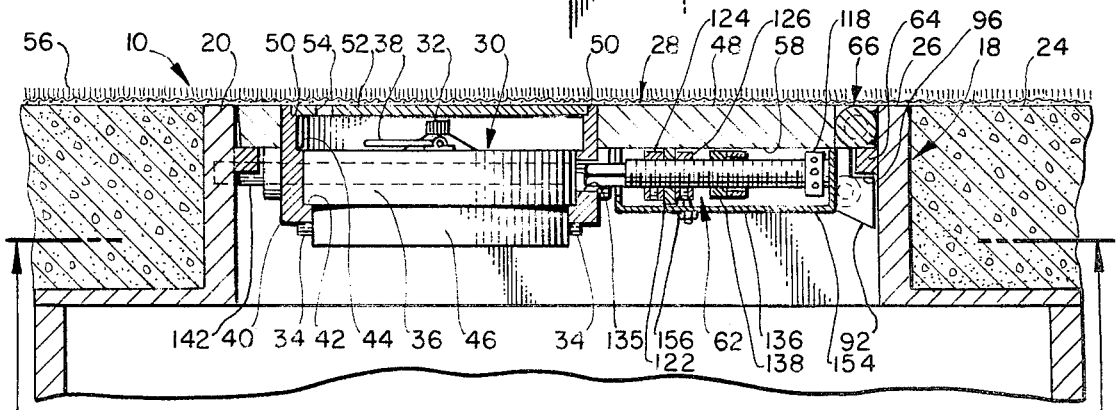
FIG. 3.

FIG. 6.
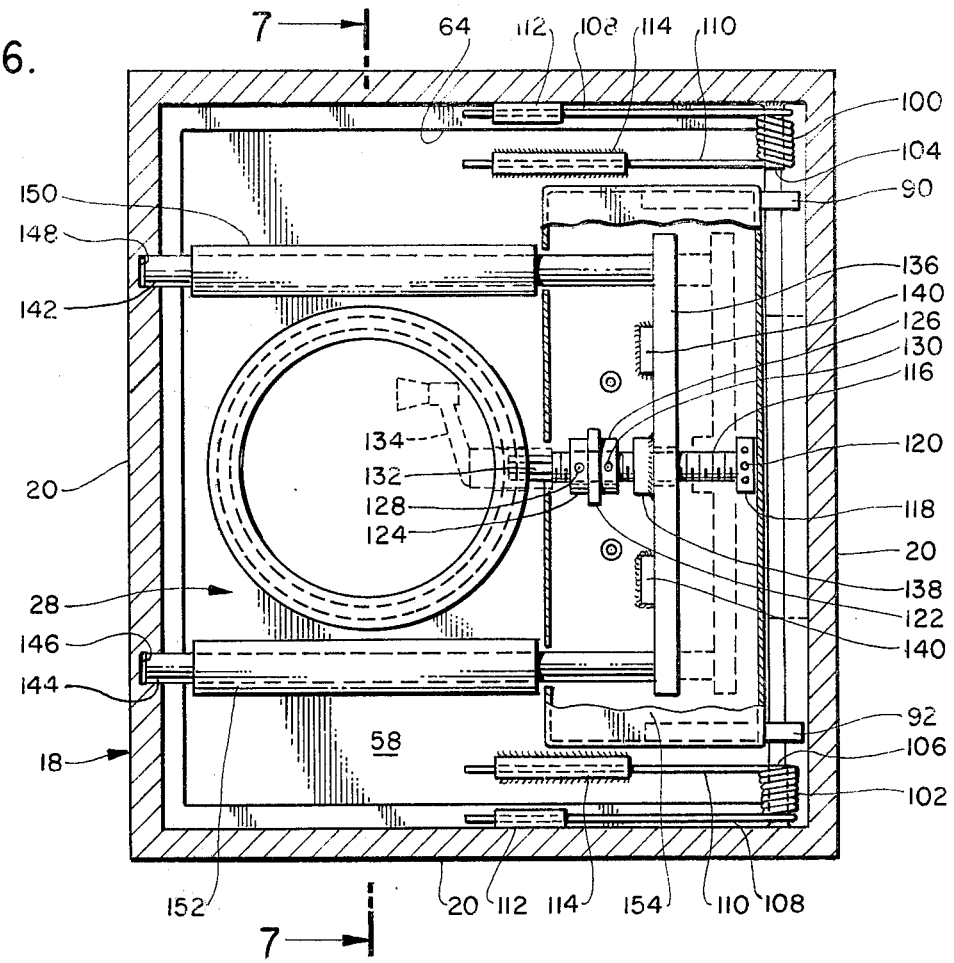
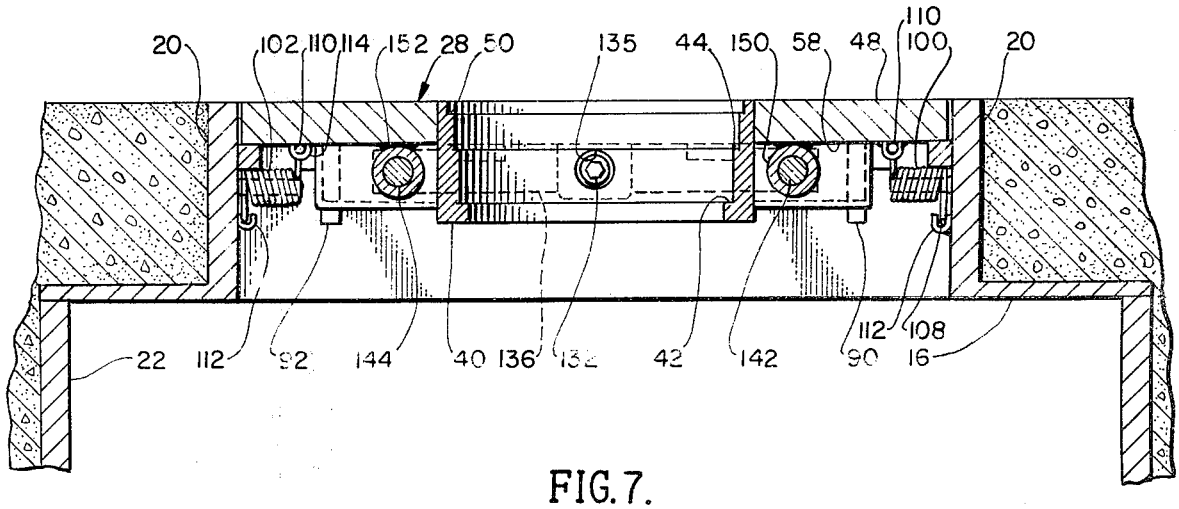
FIG. 7.

MULTIPLE ENTRY CLOSURE FOR A SAFE OR VAULT

Heretofore, safes or vaults whether free-standing, mounted in a floor or wall have been fitted with but one locking device usually that of a lift-out, hinged or swing away door. Examples of such lock doors can be found in U.S. Pat. No. 3,747,541 and other commercial safes or vaults.

Each of the conventional doors are usually round, square or rectangular and are adapted to fit into a corresponding opening in the side or top of the safe or vault. These doors usually possess radiating pins, bolts or bars to engage openings in the door or surface or interior to prevent removal of the door when locked. They can also possess relocking devices, such as described in U.S. Pat. No. 3,158,017, and drive resistant hard plate in the interior of the conventional door and the drop-in point for the locking mechanism can be randomly located, which means there can be no single point of drill attack between doors when locked. The doors usually include a combination lock to engage and move the locking pins, bolts or bars from a closed to open position.

To the best of applicant's knowledge there have been no prior art devices which have made an endeavor to incorporate any additional door or entry means of a larger diameter than the lift-out or swing-out doors to gain better access to the inside of the safe or vault. Applicant is however aware of the following patents, none of which appear to include the structure just recited above. These patents are U.S. Pat. No. 411,699, U.S. Pat. No. 1,078,764, U.S. Pat. No. 2,101,470 and U.S. Pat. No. 3,762,789.

As can be seen from some of the aforesaid prior art, these appears to be various types of combination locks built into doors of walk-in walls etc. wherein when the combination lock is in proper registry the pins or locking means built into the door will open and allow the door to open. However, this of course, again only utilizes the principle of a single entry means to gain some form of full entry into the cabinet of the safe or vault.

SUMMARY OF THE INVENTION

The present invention is a multiple entry closure for safes or vaults, wherein there is a large door which is fitted into the top or side of a safe, vault or room. The door possesses a locking means separate and independent from anything else. In addition, to complete the multiple entry closure, there is provided a lift-out door mounted within the larger other door and of a much smaller perimeter than that of the enlarged door.

It is one of the objects of the invention to provide a multiple entry closure for a safe or vault whereby the opening of the smaller lift-out door will only allow limited access to the interior of the cabinet of the safe or vault. In other words, it will only allow access no greater than the perimeter of the opening. This will for some purposes be sufficient to allow the withdrawal of small articles within the safe or vault. However, when it is desirable to remove something that is larger than the lift-out door opening, there is an additional hinged door which may be unlocked by an appropriate means, whereby full access may be had to the interior of the cabinet of the safe or vault.

A further object of this invention is to require the removal of the first lift-out door in order for the second hinged door mechanism to be activated to open or close the larger hinged door.

It is a further object of this invention to provide a complete safe or vault being tamperproof whereby even if access could be gained through the lift-out door, there would be no feasible way for an intruder bent upon malicious entry to unlock the larger door and swing it open to gain full access to the cabinet of the safe or vault.

Another object of the invention is to provide a plurality of safe-guards built into the multiple entry closure for safes or vaults which prevent or minimize malicious and undesired entry by removal or mutilation of the enlarged hinged door.

Other objects and advantages of this invention may be brought out in the following specifications wherein small details have been described for the completeness of disclosure without intending to limit the scope of the invention which is set forth in the appended claims.

BRIEF DESCRIPTION OF THE DRAWINGS

FIG. 1 is a perspective view of the multiple entry closure for a safe or vault, mounted in a floor;

FIG. 2 is a perspective view similar to FIG. 1 but with the lift-out door removed from the multiple entry closure;

FIG. 3 is a side elevational view partially in section taken on line 3—3 of FIG. 1;

FIG. 4-A is a sectional view taken on lines 4A—4A of FIG. 4;

FIG. 6 is a view of the enlarged hinged door from the bottom showing further details of the locking means mechanism; and FIG. 7 is a side elevational partially sectional view taken on line 7—7 of FIG. 6.

DETAILED DESCRIPTION OF THE PREFERRED EMBODIMENTS

Figure 4:
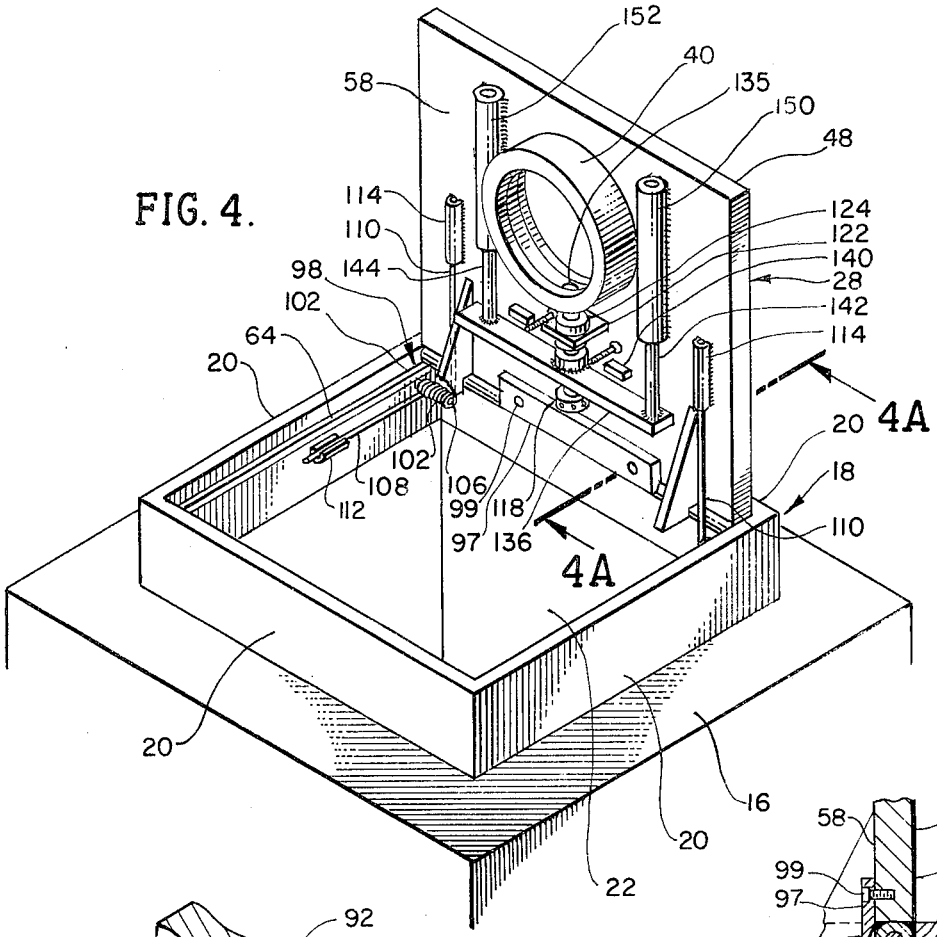
FIG. 4 is a perspective view of the top surface of the multiple entry closure, wherein the larger or hinged door is open, having full exposure to the cabinet of the safe or vault itself.

Referring to the drawings and particularly FIGS. 1 and 2 there is provided a multiple entry closure generally designated 8, which includes for the sake of illustration a safe or vault 10 with side walls 12 and 14 and additional opposed walls not seen forming the cabinet portion below the multiple entry closure 8. The safe or vault has a top 16 which is fitted with the multiple entry closure 8 having an upstanding collar generally designated 18. For the purpose of illustration, the collar 18 includes side walls 20 which are joined as best seen in FIGS. 1, 2 and 4 forming the multiple entry collar 18.

The top of a safe or vault and upstanding collar 18 are preferably formed of steel wherein the respective abutting walls may be electrically welded or otherwise secured to the multiple entry closure 8, so that the walls 12, 14 and top 16 form the enclosed cabinet 22 adapted to receive valuables for safe-keeping. The interior of the cabinet 22 may be appropriately lined with material or painted as desired.

The multiple entry closure 8 shown in FIGS. 1 and 2 is preferably welded to the safe or vault 10 and the entire unit preferrably mounted into a basement or floor so that it is generally known as a "floor safe" or "in-floor-vault." However, the multiple entry closure 8 can also be mounted in a wall for an entry into a room, or be free standing without departing from the spirit of the invention. As can be seen in FIGS. 1 and 2 concrete 24 is preferrably poured around the multiple entry closure 8 and safe or vault walls 12 and 14 to encase the unit and up to the top edge 26 of the side walls 20 forming the collar 18 to encase the safe. In this way the floor formed by the concrete will be flush with the top edge 26 such as best shown in FIG. 3.

Appropriately fitted within the opening formed by the collar 18 is a generally rectangular hinged door 28. The door 28 is also preferrably made of steel and by means to be hereinafter described appropriately hinged to the collar 18. As can be seen from the drawings it is preferred that the perimeter of the door 28 be of sufficient size to allow relatively unobstructed and full entry to the safe or vault when the hinged door is open such as seen in FIG. 4. The size of the door 28 can of course, vary depending upon the other dimensions of the safe or vault 10.

Before proceeding with the detail of construction of the hinged door 28 it is necessary to point out and describe the following first or lift-out door generally designated 30 which may be of the conventional type wherein there is a dial combination lock 32, or any other magnetic, electronic or mechanical means, which is linked to a number of sliding locking pins, bolts or bars 34. The pins 34 are usually adopted to simultaneously retract or extend from the annular side 36 of the lift-out door 30, as best seen in FIG. 3.

The lift-out door 30 is fitted with the hingeable handle 38, so that upon opening of the appropriate combination 32 and a retraction of the sliding lock pins, bolts or bars 34 the handle 38 may be raised to the vertical and the entire door 30 lifted from the opening created by an annular collar 40 extending inwardly from the hinged door 28. This annular collar 40, as best seen in FIGS. 2, 3 and 7, is preferrably formed with a first annular shoulder 42 adjacent the bottom of the collar 40 and a second annular shoulder 44 of a greater diameter than the shoulder 42. The purpose of the first annular shoulder 42 is to act as a seat to receive the lift-out door 30, as best seen in FIG. 3. The annular side 36 of the lift-out door 30 has an inward projection at the bottom which is also annular and is the lock pin holding cover 46 being of a slightly less diameter than the annular wall 36. Thus, when the lift-out door 30 is lowered into the opening created between the annular collar 40 it will come to rest on the shoulder 42 as seen in FIG. 3. Upon appropriate locking connection (not illustrated) between lock 32 and locking pins, bolts or bars 34 the pins will extend outwardly and can either extend under the collar 40 as shown in FIG. 3 or if the collar 40 is of a greater length than the lift-out door, the pins can extend into appropriate openings in the annular side wall 36.

Turning now to the second annular shoulder 44 it can be seen that this shoulder is inward of the outer surface 48 of the hinged door 28 so as to allow the lift-out door 30 to rest below the top 48, of the hinged door 28.

Additionally, adjacent the top of the annular collar 40 there is a third slight annular step 50 to receive a dust cover 52, or lift-out door of different design. This dust cover 52 is adapted to rest upon the annular step 50 and the top thereof is flush with the outer surface 48 of the hinged door. The dust cover 52 may be fitted with a finger hole 54 to remove the same for access to the locking mechanism 32. Again in the preferred embodiment the dust cover of the present invention is preferrably made of steel and of a strength to withstand foot pressure which may be exerted on the top thereof. Ideally this multiple entry as illustrated is mounted as aforedescribed in cement so that when the dust cover is in place the hiding place of the safe or vault will not be exposed.

In most cases particularly in the situation where the safe or vault 10 is in a home, office or other area which is fitted with appropriate furniture, carpeting 56 may be laid on top of the concrete, hinged door 28, and dust cover 52 to completely disguise the location of the multiple entry closure and the safe or vault.

It is preferrable in the construction of the multiple entry closure 8 that throughout the tolerances between the respective parts are relatively close for the reasons of preventing the entry of water, dust, etc. and also to prevent the entry of an object which might be used to illegally effect entry into the multiple entry closure 8.

Should someone find the hiding place of the multiple entry closure 8, underneath the carpeting 56, and after removing the dust cover 52 endeavor to gain entry they will be initially thwarted by the first or lift-out door 30 as can be seen from the drawings. A forced entry might be tried with an implement by trying to insert the implement between the annular collar 40 and the annular side 36, or drill through the top of the lift-out door 30. However, even should an instrument be able to be inserted, the locking pins, bolts or bars 34 are of such a strength preferrably made from hardened steel, that it would be virtually impossible to lift out from its seat in the collar 40 the door 30.

There are of course, other malicous unlawful entry means which might be attempted to gain access into the opening formed by the annular collar 40. However, even if the entry were finally successful as by explosives, removal of the combination lock 32, etc., this of course does not gain full entry into the multiple entry closure 8. As can be seen, the entry is restricted to the diameter of the opening created by the annular collar 40. This, by design, is relatively small.

The second hinged door 28 will now be described in further detail. The door per se includes a top or outer surface 48 as previously described and a bottom or under surface 58. The door is preferrably made from relatively thick sheet of hardened steel and preferrably considerably thicker than the side walls 20. The rectangular hinged door 28 is preferrably hinged and connected to the collar 18 by means of a hinge generally designated 60 and thus seen in FIG. 5 which is recessed so as to be flush with the surface of the concrete 24 and the top 26 of the collar 18. In addition to the special hinge 60, the door 28 is fitted with an appropriate lock mechanism generally designated 62 which is of the screw type to be defined in greater detail.

Figure 5:
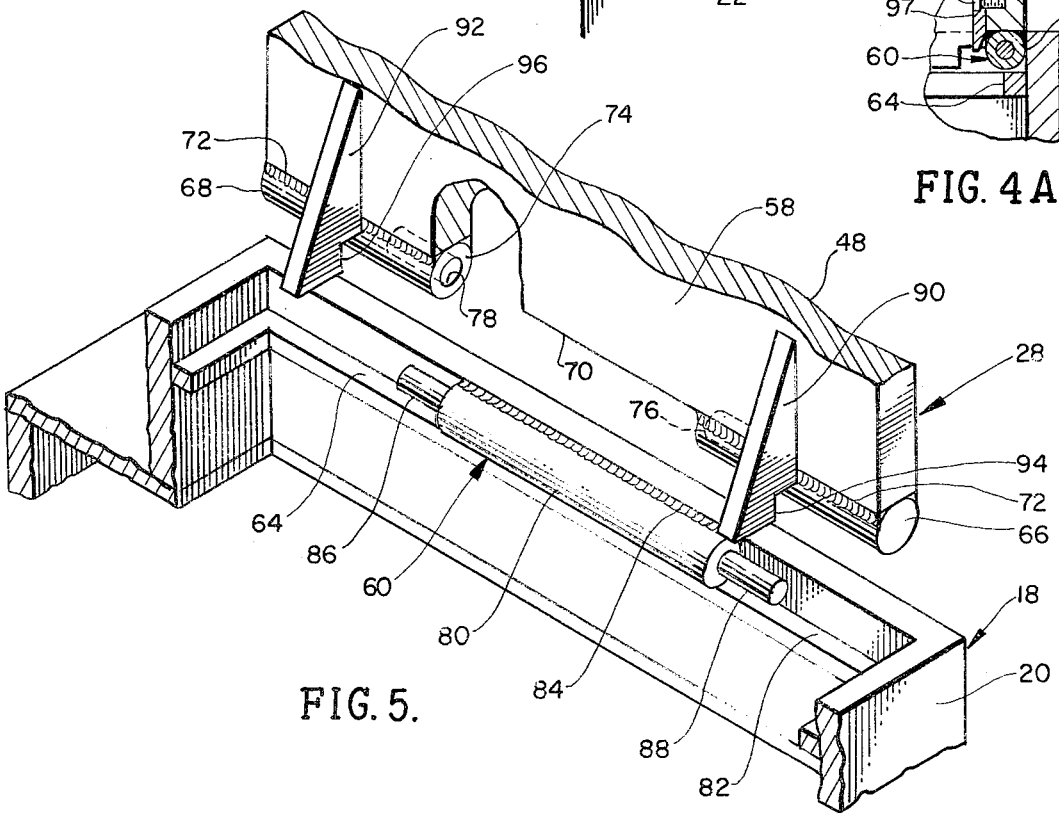
FIG. 5 is a perspective view of the hinge mechanism for the enlarged hinged door.

Around the inner periphery of the side walls 20 there is an annular inwardly extending rest lip 64 as best seen in FIG. 5 upon which the door 28 may rest when in the closed position as shown in FIGS. 1 through 3 and 4. The lip 64 is electrically welded or otherwise secured to the collar 18. This door lip 64 can also act as both a seal to prevent dust and other impurities from entering the multiple entry closure 8 and to prevent the insertion of an instrument between the door 28 and the collar 18 to pry the door loose from a locked position within the collar 18.

The hinge generally designated 60 is of a sectional type wherein outer sections are secured to the door 28 and middle section secured to interior of the collar 18.

In the preferred embodiment, as best seen in FIG. 5, there are a pair of outer hinge sections 66 and 68 which are elongated bar stock which stock is solid in cross section and when secured to the door, each extends inwardly from opposed edges of the door 28 toward the center. Each of these sections 66 and 68 are attached to the back edge 70 on top and underneath to the door 28 by welding 72. The sections 66 and 68 are appropriately drilled at ends 74 and 76 respectively, forming bores 78. The sections 66 and 68 are also appropriately drilled on the underside through to the inside of each bore 78 on each side to provide a lubrication access 67 and 69 in sections 66 and 68, whereby hinge pins can periodically be lubricated.

The center section 80 of the hinge 60 is also formed of an elongated bar stock which is solid in cross-section as are the outer sections 66 and 68. This section is secured to the interior of the collar 18 abutting the upper surface 82 of the door lip 64, and abutting the top edge of the collar 26 by welding 84. At each end of the center section 80 which has been drilled, pins 86 and 88 are inserted.

In assembling the complete hinge 60, the outer sections 66 and 68 are positioned so that the pins 86 and 88 interfit within the bores 78 to form the complete hinge. After the hinge is thus assembled, the sections are welded to the door 28 and collar 18 respectively as discussed above. Preferrably, the pins 86 and 88 have a relatively thick diameter so that in full assembly the hinge 60 is classified as heavy duty. The hinge is recessed so that the top is flush with the top surface of the door 28.

Positioned inwardly from opposed ends of the door 28 are a pair of secondary locking stays 90 and 92. These stays are welded or otherwise secured to the bottom or undersurface 58 of the door 28. The configuration of these locking stays includes a notch 94 and 96 at the back portion of the stay which is of a configuration to wrap around and generally conform to the side and bottom of the door lip 64 as best seen in FIG. 3. The purpose of the locking stays 90 and 92 is to provide additional locking protection should the entire hinging mechanism 60 be illegally removed. They are of such design and dimensions to securely maintain the multiple entry door 28 in its closed position.

Figure 4A:
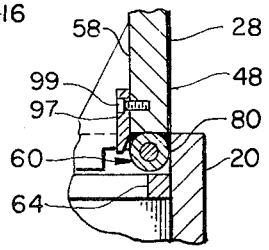

In addition to the details of the hinge which have previously been discussed, the inventor contemplates an additional element to prevent unlawful access to the hinge means 60 in that there is provided an elongated plate 97 which may be secured to the undersurface 58 of the door 28 by means of screws or bolts 99. The elongated plate 97 extends downwardly and overlaps the central hinge section 80 and the joint whereby the outer hinge sections 66 and 68 are united with the center section 80. This again will prevent improper tampering with the hinge 60. It will be seen in FIG. 4A that the plate 97 is preferrably tapered on the bottom side section thereof so that as the door moved from its open position such as seen in FIG. 4A, to a closed position, the hinge 60 in the central section at least is almost if not completely covered by the plate means to prevent tampering therewith.

In order to prevent free fall of the door 28 when in that open position such as seen in FIGS. 4 and 5, there are provided spring means generally designated 98 to slow or retard the descent of the hinged door 28 and assist in the opening of the door 28. Preferrably, the spring 98 includes a pair of sear springs 100 and 102 mounted on each side of the door 28, as best seen in FIGS. 4 and 6. The sear springs 100 and 102 are mounted on each side of the door 28 each around a sear axis pin 104 and 106 projecting outwardly beneath the door lip 64 from the collar 18. Each of the sear springs 100 and 102 includes end extensions 108 and 110. The end extension 108 is cradled in a spring stop 112 which will cradle and receive the end 108. With regard to the end extension 110 there is a spring retention collar 114 mounted on each side of the door 28.

When the door 28 is moved upwardly there is no pressure on the springs 100 or 102 which are loosely mounted for rotation on the pins 104 and 106. However, as the door 28 is moved to the closed position, the springs 100 and 102 will act to deter free fall of the door. This is accomplished by the spring extension 108 bearing downwardly against the stop 112 and the end extension 110 will be slidingly maintained within the collar 114 and be prevented from becoming disengaged as the coils of the sear springs 100 and 102 are tightened around the pin and retard the door from free fall.

Turning now to the lock mechanism generally designated 62 as best seen in FIGS. 4 and 6 there is provided an Acme type threaded screw 116. The Acme threaded screw 116 is mounted on the door 28 to the bottom or underside 58. At one end of the screw 116 which is adjacent to the hinge is a screw stop collar 118, which is threadably mounted on the screw at the end thereof and appropriately affixed to the screw by set screw 120 to prevent moving. Inwardly of the stop collar 118 there is provided an idler plate 122, which is welded or otherwise secured to the undersurface or bottom 58 of the door 28. On either side of the plate 122 there are a pair of set collars 124 and 126 which are affixed to the screw 116 by means of set screws 128 and 130.

At the opposite end of set screw 116 from the screw stop collar 118 there is affixed a chuck 132 which is adapted to receive a removable handle 134, best seen in FIG. 6. The handle is of any conventional type which may have a male or female section which will interfit on or within the chuck and be rotatably whereby the screw 116 can be rotated in the mountings aforedescribed. There is an opening 135 through the collar 40 to insert the handle 134. Chuck 132 protrudes partially through opening 135 to receive handle 134, but is recessed sufficiently and of such diameter in the opening 135 whereby no known tool can engage with the chuck 132 to rotate the screw 116 other than the designed removable handle 134.

Mounted on the screw 116 intermediate the stop 120 and the set collars 124 and 126 is an elongated lock control bar 136. This bar extends on either side of the Acme screw 116, as best seen in FIGS. 4 and 6, and it is fitted with threaded nut 138 which is welded or otherwise secured to the bar and is threadable mounted on the screw 116. Thus, it can be seen that as the handle 134 is rotated, the lock control bar 136 may move from a position shown on dotted lines in FIG. 6 to the full line view also shown in that same figure.

In order to prevent unrestrained forward movement of the lock control bar 136, a pair of stop plates 140 are welded or otherwise secured to the undersurface 58 of the door 28. Thus, as the lock control bar 136 is shifted forward it will engage the stop bar plates 140 and prevent further forward movement.

Secured at either end of the lock control bar 136, are a pair of elongated lock bolts 142 and 144. These extend forward away from the hinge of the door and from the control bar 136 to a point whereby when the lock control bar is in its forward position the bolts are long enough to extend into bores 146 and 148 of the front wall 20. In order to serve as guides for each of the lock bolts 142 and 144 there are provided elongated preferrably cylindrical bolt housings 150 and 152. These may be welded or otherwise secured to the undersurface 58 whereby the bolts may slide therein in and out into locking engagement with the bores 146 and 148 or out of engagement whereby the door may be opened.

Additionally, there may be provided a dust cover 154 to cover the bar 136 and collars 124 and 126 or entire underside of door 58. Nuts or screws 156 may be used to retain the cover 154 in position.

Thus in operation once the lift-out door 30 has been removed, a hand may be inserted through the opening in the door 28 to either obtain access to the bottom of the safe or vault and withdraw or deposit something of a nature that is smaller in diameter than the opening in the door 28. In addition, the handle 134, which is normally removed when the multiple entry closure 10 is locked, may be inserted into opening 135 to engage the chuck 132 and by appropriate rotation as mentioned above, the bolts 142 and 144 may be unseated from the bores 146 and 148 to unlock the door 28. The door 28 then can be manually lifted and rotated about the hinge member 60 to an open position as seen in FIG. 4. When the door 28 of the multiple entry closure 10 is in such a position as illustrated in FIG. 4, there will be complete access to the entire area within the safe or vault to remove or insert material of a larger size than the bore in door 28 which is filled by the lift-out door 30.

The invention and its attendant advantages will be understood from the foregoing description and it will be apparent that various changes may be made in the form and method of making, construction and arrangement of the parts not departing from the spirit or the scope thereof or sacrificing its material advantages, the arrangements wherein before described being merely by way of example. I do not wish to be restricted to the specific forms shown, method, or uses mentioned, except as defined in the accompanying claims, wherein various portions have been separated for clarity and reading and not for emphasis.

I claim:

1. A multiple entry closure for a safe wherein at least one surface of said safe is accessible and exposable comprising:

a collar secured to said one exposable surface extending outwardly therefrom and said collar defining an opening therethrough communicating with the interior of said safe and having an outer edge surface;

a door having inner and outer generally co-planar surfaces and the periphery of said door corresponding with said opening within said collar and said door hingedly mounted therein, so that when said door is opened full access may be had to the interior of said safe;

said door including a reduced size opening extending therethrough of lesser peripheral area than said door;

a locking means cooperating with said door and said collar whereby said door may be locked to said collar and in turn close a majority access area of said safe;

said locking means being accessible only through said reduced size opening when said door is in a closed position;

a lift-out removably mountable door within said reduced size opening including a locking means including bolt members adapted to engage a portion of said door and retain said lift-out door in said reduced size opening and in turn fully close said safe and when said door is removed allowing limited access to the interior of said safe.

2. A multiple entry closure as defined in claim 1 wherein a dust cover is provided to insert within said reduced size opening resting therein in flush relationship with said outer surface of said door.

3. A multiple entry closure as defined in claim 1 wherein said locking means cooperating with said door includes an Acme screw mounted on said interior surface and rotatable by a handle reachable through said reduced size opening, and at least one bolt member shiftably connected to said screw which is movable from a closed contact position with a portion of said safe to an open position wherein said door is free to hinge outwardly and open said safe.

4. A multiple entry closure as defined in claim 3 wherein said handle is removable from said locking means.

5. A multiple entry closure as defined in claim 3 wherein a lock control bar threadable associated with said screw extends outwardly of said screw and a pair of opposed bolts are secured thereto for locking said door.

6. A multiple entry closure as defined in claim 1 wherein said reduced size opening extending through said door is defined by an annular collar extending beyond said interior surface of said door and where said lift-out door of which includes a bolt member which are adapted to engage the inner most portion of said annular collar to retain said lift-out door in place.

7. A multiple entry closure as defined in claim 5 wherein said door is fitted within said collar flush with said outer edge surface whereby the locking means of said lift-out door when said lift-out door is positioned in said reduced size opening is recessed below the outer edge surface of said annular collar.

8. A multiple entry closure as defined in claim 1 wherein said door includes a generally tamper proof hinge having a center portion located on an inner surface of said safe in said opening, said center portion having hinge pins at appropriate ends and a pair of end mating portions each having a bore at the ends thereof adjacent the opposite ends of said center portion, whereby in assembly the pins are inserted in the bores leaving no hinge pin exposed, and said mating portions are mounted on the inner surface of said door.

9. A multiple entry closure as defined in claim 8 wherein a pair of secondary locking stays are spaced apart and secured to said inner surface of said door in the region of said hinge whereby when said door is closed said locking stays will present a block against lateral removal of said door from said opening.

10. A multiple entry closure as defined in claim 1 wherein there is provided a pair of opposed sear springs cooperating with said door and opposed sides of said safe to prevent free gravitational fall of said door, and to assist in the opening of said door.

11. A multiple entry closure as defined in claim 1 having a rectangular collar and opening therethrough, and said door is complimentary with said opening.

12. A multiple entry closure as defined in claim 9 which include an additional protective plate member mounted on said inner surface of said door between said secondary locking stays and extending outwardly of said door and projecting over said spring portions when said door is open and when closed engulfing the majority of said hinge to prevent entry of an object to disengage the hinge portions.

13. A multiple entry closure as defined in claim 1 wherein the safe is permanently affixed in a structure.

* * * * *